US011279446B2

(12) United States Patent
Yu et al.

(10) Patent No.: US 11,279,446 B2
(45) Date of Patent: Mar. 22, 2022

(54) DISCONNECTABLE TOWER YOKE MOORING SYSTEM AND METHODS FOR USING SAME

(71) Applicant: SOFEC, INC., Houston, TX (US)

(72) Inventors: Hao Yu, Katy, TX (US); Stephen P. Lindblade, Waller, TX (US); Vernon Raymond Jenkins, Crosby, TX (US); Steven Eskridge, Waller, TX (US)

(73) Assignee: SOFEC, INC., Houston, TX (US)

( * ) Notice: Subject to any disclaimer, the term of this patent is extended or adjusted under 35 U.S.C. 154(b) by 82 days.

(21) Appl. No.: 16/839,606

(22) Filed: Apr. 3, 2020

(65) Prior Publication Data

US 2020/0317300 A1 Oct. 8, 2020

Related U.S. Application Data

(60) Provisional application No. 62/830,088, filed on Apr. 5, 2019.

(51) Int. Cl.
*B63B 21/50* (2006.01)
*B63B 21/00* (2006.01)

(52) U.S. Cl.
CPC ..... *B63B 21/507* (2013.01); *B63B 2021/002* (2013.01); *B63B 2021/505* (2013.01)

(58) Field of Classification Search
CPC ..... B63B 21/507; B63B 2021/002; B63B 2021/505; B63B 21/50
See application file for complete search history.

(56) References Cited

U.S. PATENT DOCUMENTS

| | | | |
|---|---|---|---|
| 4,088,089 | A | 5/1978 | Flory |
| 4,114,556 | A | 9/1978 | Orndorff, Jr. et al. |
| 4,119,051 | A | 10/1978 | Orndorff, Jr. |
| 4,191,256 | A | 3/1980 | Croy et al. |
| 4,516,942 | A | 5/1985 | Pedersen |
| 4,568,295 | A | 2/1986 | Poldervaart |

(Continued)

FOREIGN PATENT DOCUMENTS

| | | |
|---|---|---|
| EP | 0298559 | 1/1989 |
| EP | 0337531 | 7/1992 |

(Continued)

OTHER PUBLICATIONS

Third-Party Observations from EPO for European Patent Application No. 16860549.1 dated Nov. 5, 2020.

(Continued)

*Primary Examiner* — Anthony D Wiest
(74) *Attorney, Agent, or Firm* — Edmonds & Cmaidalka, P.C.

(57) ABSTRACT

A yoke mooring system and method for disconnecting a moored vessel from a tower structure. The system can include a support structure with one or more extension arms suspended from the support structure. A ballast tank can be connected to the one or more extension arms, and a yoke can extend from and connect to the ballast tank. The yoke can include a tower connector disposed on a second end thereof for connecting to the tower structure. A first winch system can be located on the support structure and connect to the yoke proximate a second end of the yoke via a first line or cable. A second winch system can be connected to the ballast tank via a second line or cable.

20 Claims, 12 Drawing Sheets

(56) References Cited

U.S. PATENT DOCUMENTS

| | | | | |
|---|---|---|---|---|
| 4,798,155 | A * | 1/1989 | Poldervaart | B63B 22/025 114/230.14 |
| 6,227,135 | B1 | 5/2001 | Pedersen | |
| 6,923,225 | B2 | 8/2005 | Poldervaart et al. | |
| 7,007,623 | B2 | 3/2006 | Boatman et al. | |
| 8,104,417 | B1 | 1/2012 | Shivers, III et al. | |
| 8,763,549 | B2 | 7/2014 | Liu et al. | |
| 9,038,558 | B2 * | 5/2015 | Balleraud | B63B 39/03 114/230.15 |
| 9,573,659 | B2 | 2/2017 | Liu et al. | |
| 2001/0029879 | A1 | 10/2001 | Cottrell et al. | |
| 2003/0226487 | A1 | 12/2003 | Boatman et al. | |
| 2004/0094082 | A1 | 5/2004 | Boatman et al. | |
| 2005/0106959 | A1 | 5/2005 | Storvoll et al. | |
| 2008/0011357 | A1 * | 1/2008 | Wille | B63B 21/00 137/234.6 |
| 2010/0326667 | A1 | 12/2010 | Coppens | |
| 2014/0014017 | A1 | 1/2014 | Balleraud et al. | |
| 2014/0034137 | A1 | 2/2014 | Kelly et al. | |
| 2017/0113762 | A1 | 4/2017 | Lindblade | |

FOREIGN PATENT DOCUMENTS

| | | |
|---|---|---|
| EP | 1826116 | 8/2007 |
| EP | 2070812 | 6/2009 |
| EP | 2646725 | 10/2013 |
| WO | 03/076262 | 9/2003 |
| WO | 2006/065130 | 6/2006 |
| WO | 2012/123191 | 9/2012 |
| WO | 2015055327 | 4/2015 |
| WO | 2015/126320 | 8/2015 |

OTHER PUBLICATIONS

"A challenging mating operation between VLCC class FPSO and soft yoke mooring system in extremely shallow water", conference paper, Texas, USA, publication date Apr.-May 2012.

International Search Report and Written Opinion for International Application No. PCT/US2020/046803 dated Nov. 30, 2020.

International Search Report and Written Opinion for International Application No. PCT/US2020/026572 dated Jul. 20, 2020.

International Search Report and Written Opinion for International Application No. PCT/US2020/026586 dated Jul. 22, 2020.

Wellman Dynamics Machining and Assembly Inc. "The Most Reliable Locking Device Bear-Loc." Bear-Loc. York, PA. <http://www.wdmachining.com>, undated.

International Search Report and Written Opinion for International Application No. PCT/US2016/058149, dated Dec. 2, 2016.

* cited by examiner

Figure 12 step 1210 providing a floating vessel moored to a tower structure, the floating vessel comprising: a support structure mounted on an upper deck thereof; one or more extension arms suspended from the support structure; a ballast tank connected to the one or more extension arms, the ballast tank configured to oscillate back and forth underneath the support structure; a yoke extending from and connected to the ballast tank at a first end thereof, the yoke comprising a tower connector disposed on a second end thereof; a first winch system located on the support structure, the first winch system connected to the yoke proximate the second end of the yoke via a first line or cable; and a second winch system connected to the ballast tank via a second line or cable, wherein the tower connector is attached to a yoke head connector disposed on the tower structure optional step 1220 orienting the yoke head connector and the tower connector to be substantially horizontal step 1230 applying stern thrust to the vessel, away from the tower structure step 1240 releasing the tower connector from the yoke head connector step 1250 controlling vertical movement of the yoke using the first winch system located on the support structure step 1260 controlling the back and forth movement of the ballast tank using the second winch system

DISCONNECTABLE TOWER YOKE MOORING SYSTEM AND METHODS FOR USING SAME

CROSS-REFERENCE TO RELATED APPLICATION

This application claims priority to U.S. Provisional Patent Application No. 62/830,088, filed on Apr. 5, 2019, which is incorporated by reference herein.

BACKGROUND

Field

Embodiments described generally relate to offshore mooring systems. More particularly, embodiments described relate to a mooring system for disconnecting a vessel from an offshore tower structure while at sea, such as a tower structure used for hydrocarbon production.

Description of the Related Art

In the drilling and production of offshore oil and gas, mooring systems have been used to connect FPSO, FSO, and other floating vessels to various tower structures in the open sea. Some conventional mooring systems are permanent, meaning the connected vessel can be maintained on location with a fixed heading. Such permanent mooring systems are thus dependent on a site where the severe weather can be directional. Other conventional mooring systems are disconnectable, allowing vessels to leave the field, such as to avoid severe weather events and conditions like harsh seas, typhoons, hurricanes and icebergs.

Conventional mooring systems, whether permanent or disconnectable, have used rotating systems to allow the vessel to weathervane about its mooring point to better accommodate changing sea conditions. Conventional rotating systems have used turret systems that are internal or external to the vessel as well as turntable type buoys. Such rotatable systems allow the vessel to weathervane in normal to severe conditions, including those harsh environments offshore where seasonal cyclonic weather systems or icebergs are predominant.

Turntable type buoys are not suitable for harsh offshore environments. Turret type systems are more common. One problem with conventional turret systems, however, can be the size and complexity of the systems as well as the need for an associated swivel stack for fluid, gas, chemical, hydraulic power, electrical power and control transfer. Another problem with conventional turret type mooring systems can be the need to timely disconnect the vessel to avoid typhoons, hurricanes, icebergs, and other extremely dangerous conditions that may or may not have appropriate advance notice. The disconnect and reconnect sequence can be time consuming, which results in more lost production time, injury or worse.

Tower mooring systems are another type of mooring solution used in shallower waters where the tower structure can be fixed to the seabed. Conventional tower structures typically include a bearing system that allows one part to rotate around a fixed geostatic part. When moored to the rotating part of the tower structure with a mooring connection, the vessel can weathervane around the geostatic part of the tower structure. Typical mooring connections include a hawser system or other rope, chain or elongated connection. Another mooring connection has been a soft yoke wishbone type system, which includes a rigid steel frame that can be connected to the tower structure using a series of hinges and to the vessel with the help of a pendulum structure. Production fluids are transferred from the tower across swivels located on the turntable and through hoses from the turntable to the vessel. The tower typically includes deck space for a manifold and other processing equipment. Access to the tower can be made via walkways that extend from the vessel across the yoke to the tower.

Typical tower yoke mooring systems are used in areas of shallower waters not prone to large storms or extreme sea conditions that require the vessel to temporarily leave the area to avoid the danger. Conventional tower yoke mooring systems can be disconnected, but the process can be extremely time consuming and often requires external intervention.

To be safely used in areas subject to more extreme offshore conditions, it can be highly desirable to have a tower yoke mooring system that can be easily disconnectable and reconnectable from the vessel itself, without external intervention, and able to be connected and disconnected in hours versus days or weeks.

SUMMARY

The present invention provides an improved system and method for connecting and disconnecting a floating vessel to a tower structure, while at sea, using the vessel itself without external intervention and performed in hours versus days or weeks. In one embodiment, the tower yoke mooring system includes a support structure mounted on an upper deck thereof; one or more extension arms suspended from the support structure; a ballast tank connected to the one or more extension arms, the ballast tank configured to oscillate back and forth underneath the support structure; a yoke extending from and connected to the ballast tank at a first end thereof, the yoke comprising a tower connector disposed on a second end thereof; a first winch system located on the support structure, the first winch system connected to the yoke proximate the second end of the yoke via a first line or cable; and a second winch system connected to the ballast tank via a second line or cable, wherein the tower connector is attached to a yoke head connector disposed on the tower structure.

In one embodiment, the method for disconnecting the floating vessel moored to a tower structure comprises releasing the tower connector from the yoke head connector; controlling vertical movement of the yoke using the first winch system located on the support structure; and controlling the back and forth movement of the ballast tank using the second winch system. Prior to releasing the tower connector from the yoke head connector and thereby releasing the connection between the vessel and the tower structure, thrust may be applied to the vessel, away from the tower structure.

BRIEF DESCRIPTION OF THE DRAWINGS

The various aspects and advantages of the preferred embodiment of the present invention will become apparent to those skilled in the art upon an understanding of the following detailed description of the invention, read in light of the accompanying drawings which are made a part of this specification.

FIG. 12 is an illustrative flow process representing another method for disconnecting a moored vessel from a tower structure at sea, according to one or more embodiments provided herein.

DETAILED DESCRIPTION

Figure 1:
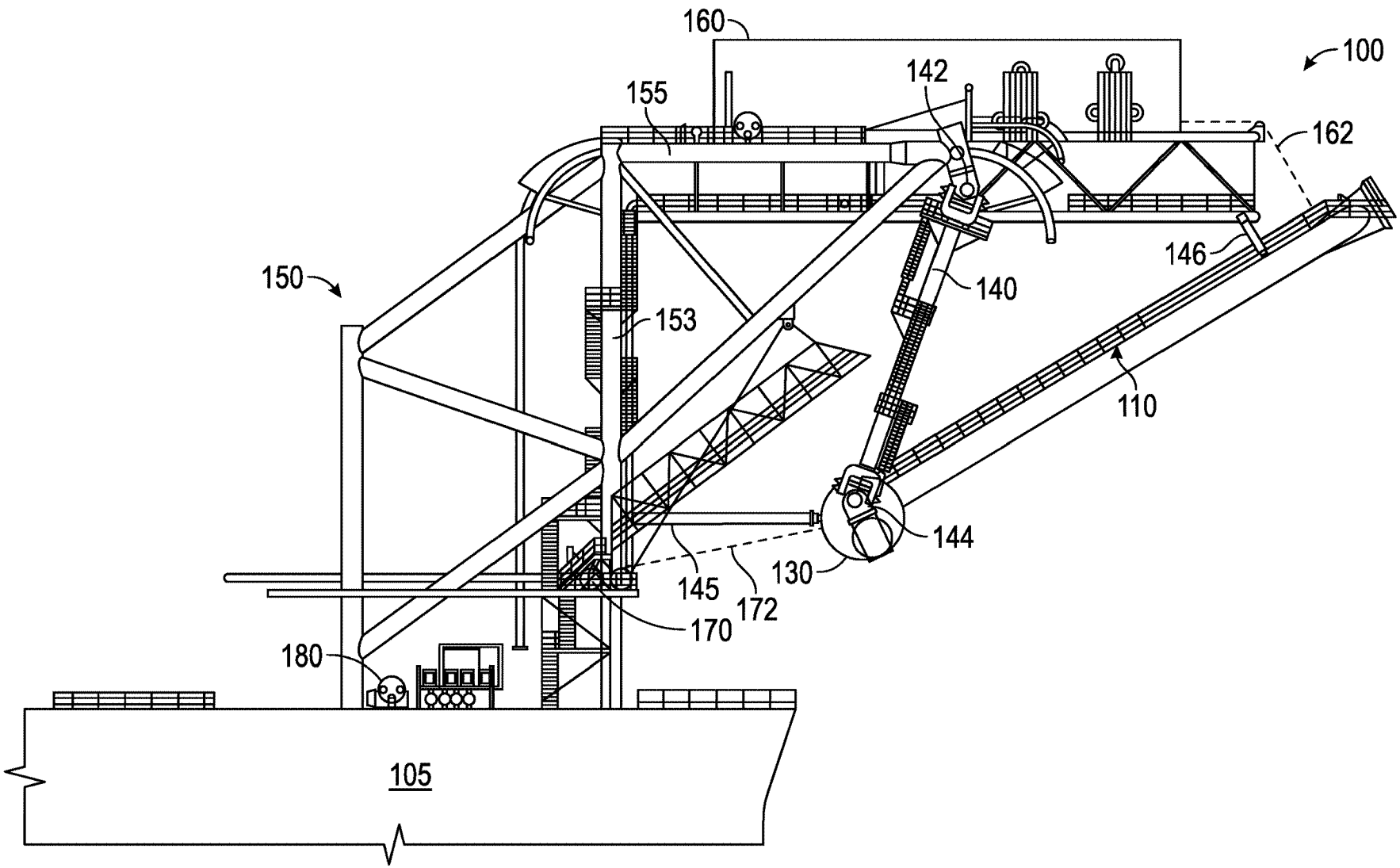
FIG. 1 depicts a schematic depicting an illustrative yoke mooring system, according to one or more embodiments provided herein. The yoke mooring system can be shown affixed to the bow of a vessel.

A detailed description will now be provided. Each of the appended claims defines a separate invention, which for infringement purposes is recognized as including equivalents to the various elements or limitations specified in the claims. Depending on the context, all references to the "invention", in some cases, refer to certain specific or preferred embodiments only. In other cases, references to the "invention" refer to subject matter recited in one or more, but not necessarily all, of the claims. It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows includes embodiments in which the first and second features are formed in direct contact and also includes embodiments in which additional features are formed interposing the first and second features, such that the first and second features are not in direct contact. The exemplary embodiments presented below may be combined in any combination of ways, i.e., any element from one exemplary embodiment may be used in any other exemplary embodiment, without departing from the scope of the disclosure. The figures are not necessarily drawn to scale and certain features and certain views of the figures can be shown exaggerated in scale or in schematic for clarity and/or conciseness.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Also, the naming convention used herein is not intended to distinguish between components that differ in name but not function. Furthermore, in the following discussion and in the claims, the terms "including" and "comprising" are used in an open-ended fashion, and thus should be interpreted to mean "including, but not limited to."

All numerical values in this disclosure are exact or approximate values ("about") unless otherwise specifically stated. Accordingly, various embodiments of the disclosure may deviate from the numbers, values, and ranges disclosed herein without departing from the intended scope.

Further, the term "or" is intended to encompass both exclusive and inclusive cases, i.e., "A or B" is intended to be synonymous with "at least one of A and B," unless otherwise expressly specified herein. The indefinite articles "a" and "an" refer to both singular forms (i.e., "one") and plural referents (i.e., one or more) unless the context clearly dictates otherwise. The terms "up" and "down"; "upward" and "downward"; "upper" and "lower"; "upwardly" and "downwardly"; "above" and "below"; and other like terms used herein refer to relative positions to one another and are not intended to denote a particular spatial orientation since the apparatus and methods of using the same may be equally effective at various angles or orientations.

Each of the inventions will now be described in greater detail below, including specific or preferred embodiments, versions and examples, but the inventions are not limited to these embodiments, versions or examples, which are provided to enable a person having ordinary skill in the art to make and use the inventions, when the information in this disclosure is combined with publicly available information and technology.

FIG. 1 depicts a schematic depicting an illustrative yoke mooring system 100, according to one or more embodiments provided herein. The yoke mooring system ("YMS") 100 can be located or otherwise disposed on a vessel 105, e.g., on a top of the vessel 105. The system 100 can include a yoke 110, a ballast tank 130, and one or more link or extension arms 140 connected to a support structure 150. The system 100 can further include a first or yoke lift winch system 160 and a second or yoke pull-back winch system 170. Each winch system 160, 170 can be electric, pneumatic, hydraulic or a combination thereof. Each winch system 160, 170 can also have motion compensation, including active heave compensation (AHC) and/or passive heave compensation (PHC). In certain embodiments, each of the winch systems 160, 170 can use any combination of AHC, PHC and tension control to rapidly and accurately lift and/or pull-back the yoke 110 as needed in harsh offshore environments.

As explained in more detail below, each winch system 160, 170 can be capable of quick movements and fast reaction times at the requisite tensions and loads to safely manipulate and control the movement of the yoke 110 while connecting and/or disconnecting to a tower structure, at sea, using only the facilities located on the vessel 105 itself. The winch systems 160, 170 can be used independently, or together. Each winch system 160, 170 can be or can include a dedicated hydraulic power unit and any combination of one or more winches, controls, compensating cylinders, sheaves, accumulators and/or oil coolers. The one or more winches and one or more compensating cylinders can be used in parallel or in series. The one or more compensating cylinders can be vertical or horizontal. In certain embodiments, the one or more winches and one or more compensating cylinders can be used in tandem (i.e. series) such that the compensating cylinders work at high speeds and low tension to gather the lines rapidly to control the swing movement of the yoke 110, ballast tank 130, or both, and the winches can be designed to handle higher tension requirements, such as during the initial lift and/or pull back upon disconnection, for example.

In operation, the first or yoke lift winch system 160, for example, can be used to hold and control movement of the yoke 110, including vertical movement of the yoke 110, while connecting and/or disconnecting to a tower structure. For example, the yoke lift winch system 160 can be used to raise, lower and hold the yoke 110 in position as the vessel 105 is pulled to the tower structure 200 for connection; and to support, handle and rapidly lift the yoke 110 during disconnection from the tower structure 200. The pull-back winch system 170 can be used to hold and control movement of the ballast tank 130, including the horizontal movement of the ballast tank 130, during disconnection and during storage for transit. The pull-back winch system 170 can be used to affect the yaw angle of the ballast tank 130 and the yoke 110. During disconnection, for example, the yoke lift winch system 160 and the pull-back winch system 170 can be used together to lift, lower, pullback and/or hold the yoke 110, preventing the yoke 110 from colliding with the tower structure 200 and causing physical damage to itself or the tower or both. The pull-back winch system 170 could be used to manipulate and control movement of the ballast tank during connection. In certain embodiments, the pull-back winch system 170 is not used during connection.

Still referring to FIG. 1, the yoke 110 can be any elongated structure with sufficient strength to connect the vessel 105 to an offshore structure. For example, the yoke 110 can be formed from one or more tubular members (111, 112 shown in FIGS. 6 and 10). Each tubular member can have a circular, squared, or other polygonal cross-sectional shape. In certain embodiments, the yoke 110 can have a pair of two legs arranged in a "V" shape that are connected to the ballast tank 130 at one end and connected to a conical coupler or yoke head 115 at the other end. When connected, the ballast tank 130, extension arms 140 and yoke 110 form a triangular shaped frame. As explained in more detail below, the ballast tank 130, extension arms 140 and yoke 110 provide a restoring force for mooring the vessel 105 to the tower structure 200.

The support structure 150 can be a raised tower or other framed structure for supporting the yoke 110, the ballast tank 130 and the extension arms 140. The support structure 150 can include a generally vertical section 153 and a generally horizontal section 155. The generally horizontal section 155 can be cantilevered. The generally horizontal section 155 can extend beyond the bow of the vessel 105 and help supports the weight of the yoke 110 and tank 130. One or more transit or connection arms 146 can be used to hold and secure the yoke 110 to the support structure 150 during transit.

The ballast tank 130 can be any container, drum or the like capable of holding water or other ballast. The ballast tank 130 can be connected to the yoke 110 and/or the extension arm(s) 140. The ballast tank 130 serves as a counterbalance or restoring force as the vessel 105 moves at sea. The ballast tank 130 can be connected to the support structure 150 through the one or more extension arms 140.

The extension arms 140 can be connected to the generally horizontal section 155 of the support structure 150 via one or more upper U-joints 142. The extension arms 140 can also be connected to the ballast tank 130 using one or more lower U-joints 144. The extension arms 140 can include one or more jointed sections that are mechanically connected together. The support structure 150 via connection through the extension arms 140 suspends the ballast tank 130. The U-joints 142, 144 are provided as one type of coupler that can be used, however, any type of coupling that permits angular movement between its connections can be equally employed.

Figure 3:
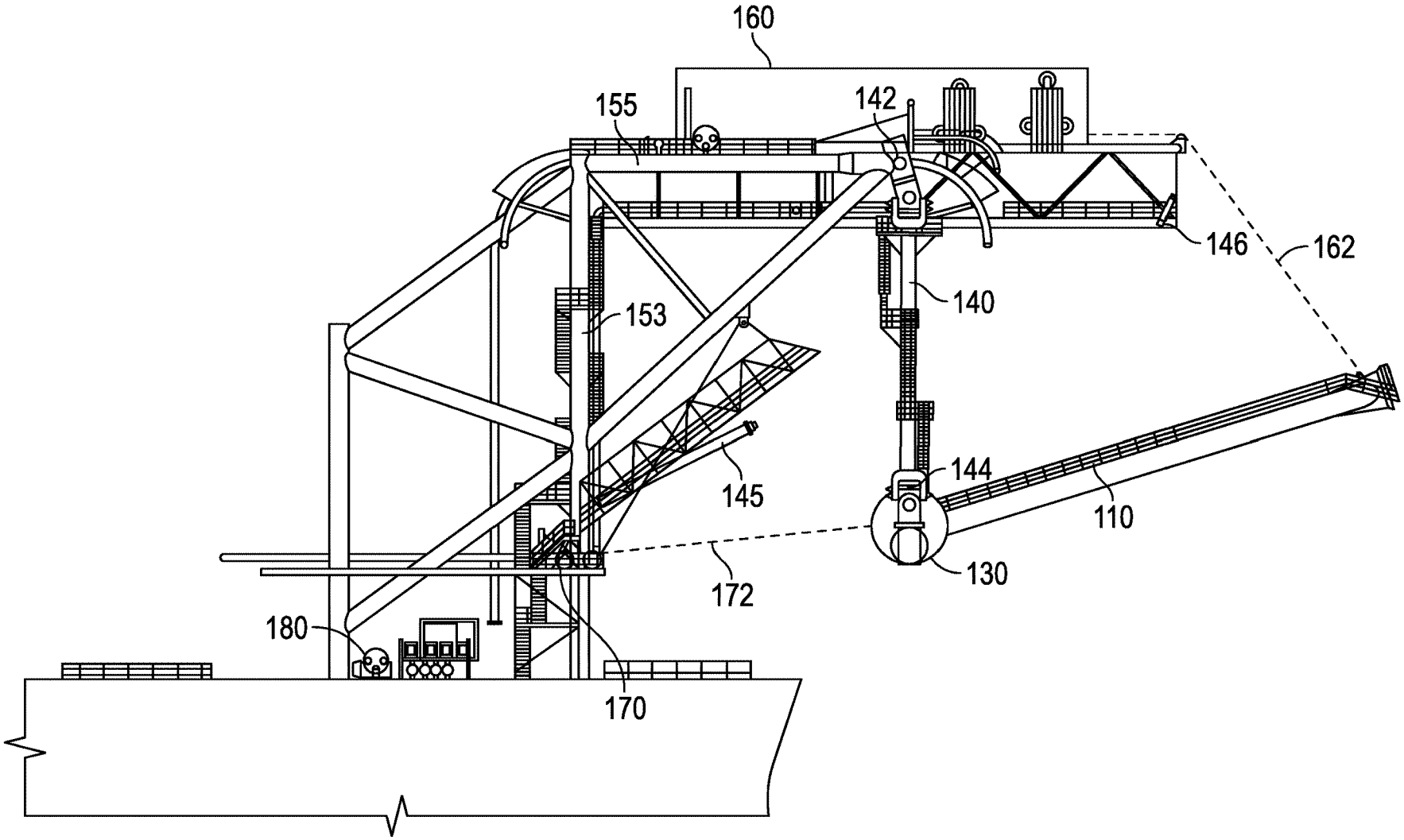
FIG. 3 depicts an illustrative schematic depicting the yoke in position ready for connection to the tower, according to one or more embodiments provided herein.

The ballast tank 130 can be secured to the generally vertical sections 153 of the support structure 150 through one or more transit or connection arms 145. Each transit arm 145 can be a telescoping or rigid member that can be connectable to the ballast tank 130 during transit or storage of the vessel 105. In FIG. 1, the YMS 100 can be shown in a stowed or transit position on top the bow of a vessel 105 whereby the transit arms 145 are securely attached to the ballast tank 130 preventing the ballast tank 130 from moving independent of the vessel 105. In FIG. 3, for example, the transit arms 145 are shown in a retracted position and not connected to the ballast tank 130, allowing the ballast tank 130 to swing freely relative to the motion of the vessel 105.

By "vessel" it can be meant any type of floating structure including but not limited to tankers, boats, ships, FSOs, FPSOs and the like. It should be appreciated by those skilled in the art that the YMS 100 can be mounted on converted vessels as well as new-built vessels.

Figure 2:
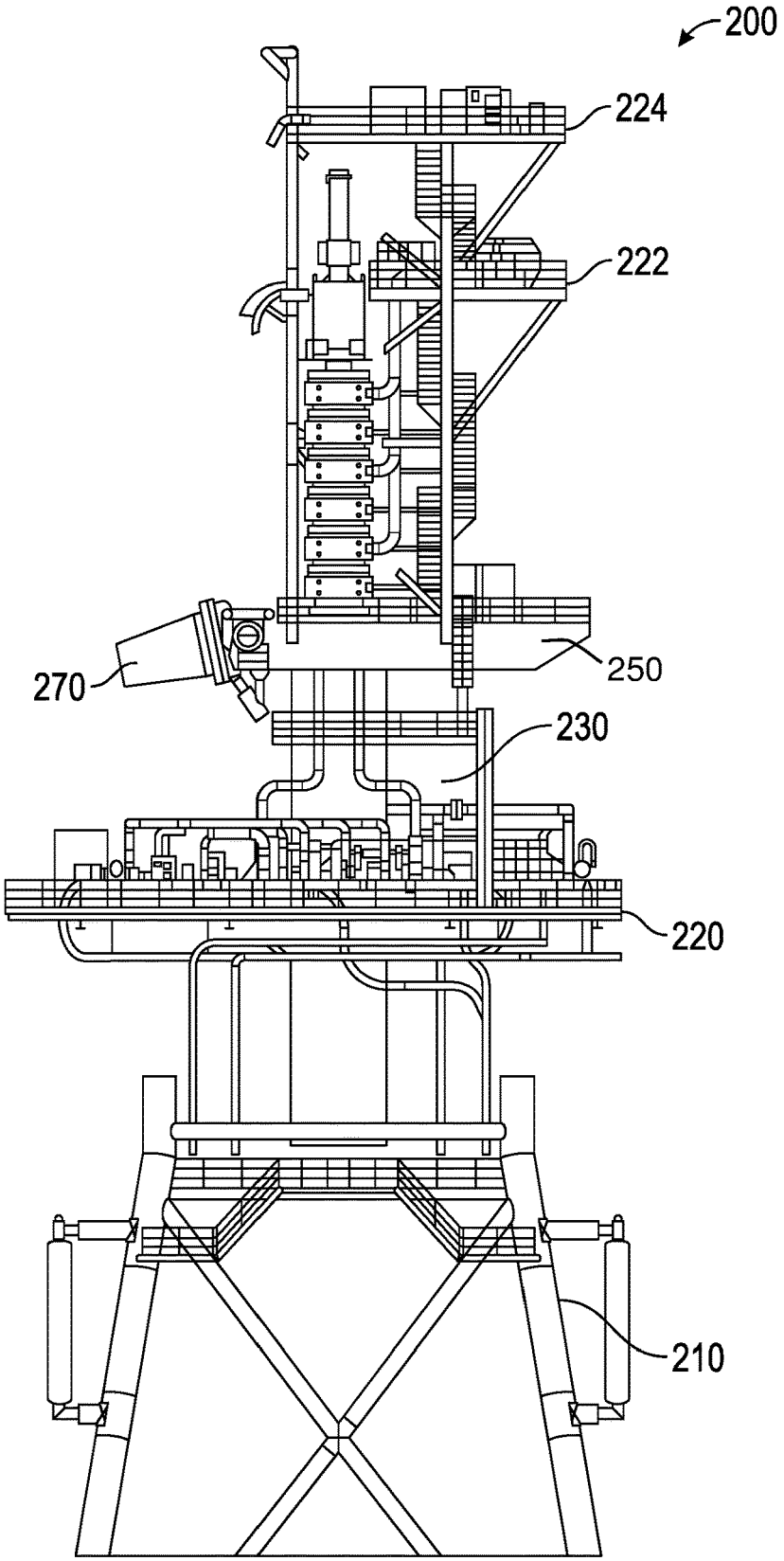
FIG. 2 depicts a schematic depicting an illustrative tower structure for connecting to the yoke of FIG. 1, according to one or more embodiments provided herein.

FIG. 2 depicts a schematic depicting an illustrative tower structure 200 for connecting to the yoke 110 of FIG. 1. The tower structure 200 can be typically fixed to the seabed but can also be floating, anchored, and/or moored. The tower structure 200 can include a base or jacket structure 210 that can be fixedly attached to the seabed and a plurality of decks 220, 222, 224 (three are shown) disposed on a support column 230 at various elevations above the water line. It can be understood by those of skill in the art that the decks 220, 222, 224 are arranged and designed to support various processing equipment, manifolds, etc.

The tower structure 200 can further include a turntable 250 disposed on the support column 230. The turntable 250 can include a roller bearing (251 in FIG. 6) to allow the vessel 105 connected via its yoke 110 to freely weathervane about the tower structure 200. Preferably, one or more decks, including a hose deck, are located above the turntable 250 and able to rotate with the turntable 250.

Referring again to FIG. 1, the yoke lift winch system 160 can be connected to the yoke 110 and the second winch system 170 can be connected to the ballast tank 130 using rope, cable, wire or the like, or any combinations of the same. The yoke lift winch system 160 can be used for controlling the movement of the yoke 110, and the pull-back winch system 170 can be used for controlling the movement of the ballast tank 130. Each winch system 160, 170 can be motion compensated to support the yoke 110 during connection and disconnection with the tower structure 200. Each winch system 160, 170 can be located on the support structure 150 or on the deck of the vessel 105. The size, weight and overall geometry of the winch systems 160, 170 can, at least in part, dictate the most advantageous location on the system 100 or vessel 105.

FIG. 3 depicts an illustrative schematic depicting the yoke 110 in position, ready for connection to the tower, according to one or more embodiments provided herein. As shown, the ballast tank 130 can be connected to the pull-back winch system 170 via wire or rope or other elongated element 172 and the second end or distal end of the yoke 110 can be connected to the yoke lift winch system 160 via wire or rope or other elongated element 162. As depicted, the transit arm 145 has been released from the ballast tank 130 and the transit arm 146 has been released from the yoke 110. Having released the transit arms 145, 146, the yoke 110 and ballast tank 130 are able to freely move with respect to the vessel 105, and such movement can be limited, manipulated and controlled by the winch systems 160, 170.

Figure 3A:
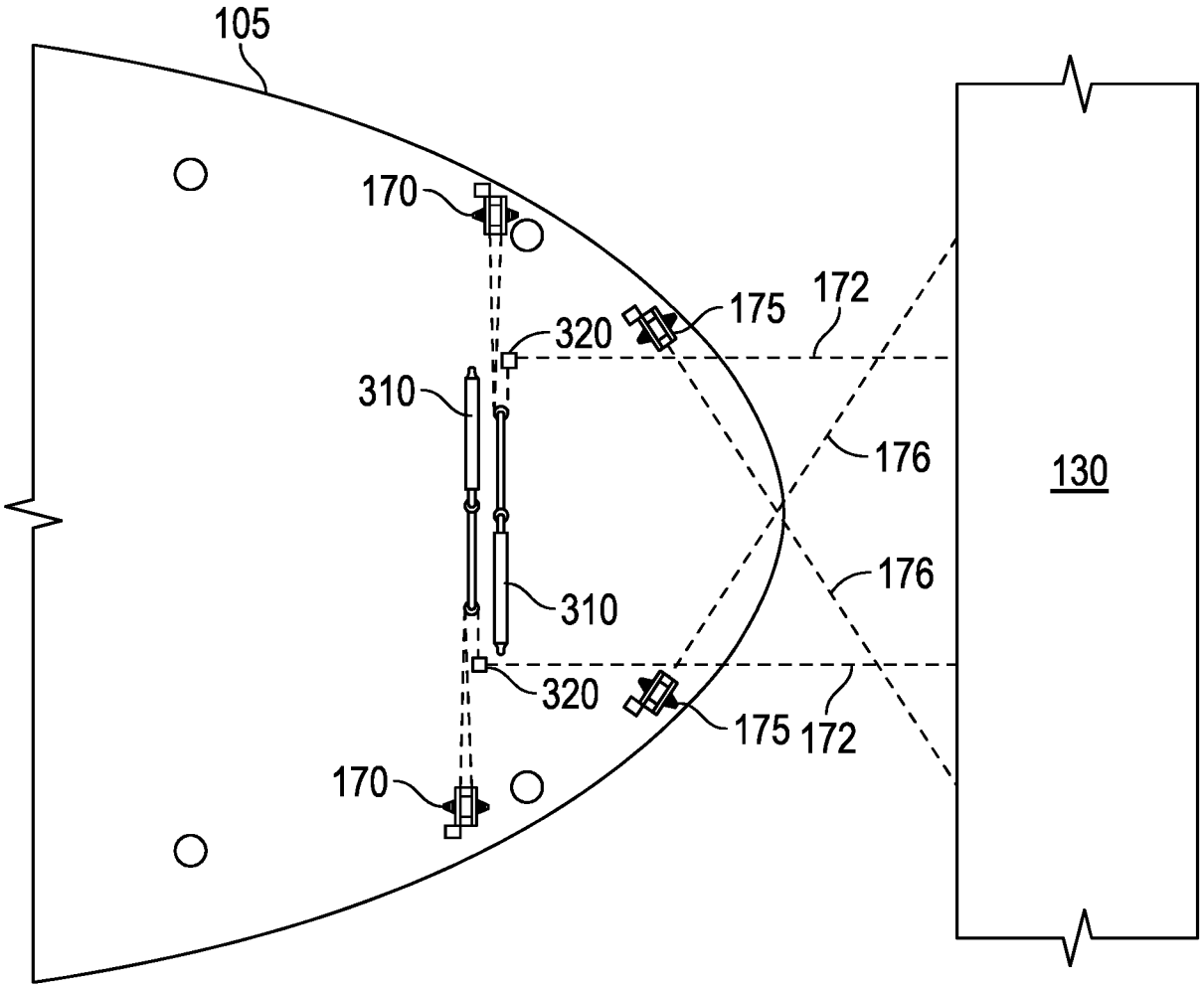
FIG. 3A depicts a schematic plan view of a vessel bow to show an illustrative arrangement for various winch systems used to control movement of the ballast tank, according to one or more embodiments provided herein.

FIG. 3A depicts a schematic plan view of a vessel bow to show an illustrative arrangement for a multitude of winches that can be used to control movement of the ballast tank 130. For example, a third winch system 175 or spring line winch system 175 can be used in combination with the pull-back winch system 170 for controlling movement of the ballast tank 130 using two or more wires or ropes or the like (spring lines) 176. In particular, the pull-back winch systems 170 can be used to primarily control the forward and back movement of the tank 130 (e.g. to and from the vessel structure 150), while the spring line winch system 175 can be used to primarily control the side to side movement of the tank 130. Like the other winch systems 160, 170, the spring line winch system 175 can be or can include a dedicated hydraulic power unit and any combination of one or more winches, controls, compensating cylinders, accumulators and oil coolers to provide rapid and reliable response times. Two horizontal cylinders 310 and sheaves 320 are shown and configured to work in tandem or in series with the pull-back winches 170 and the spring line winches 175 for controlling movement of the ballast tank 130.

Figure 4:
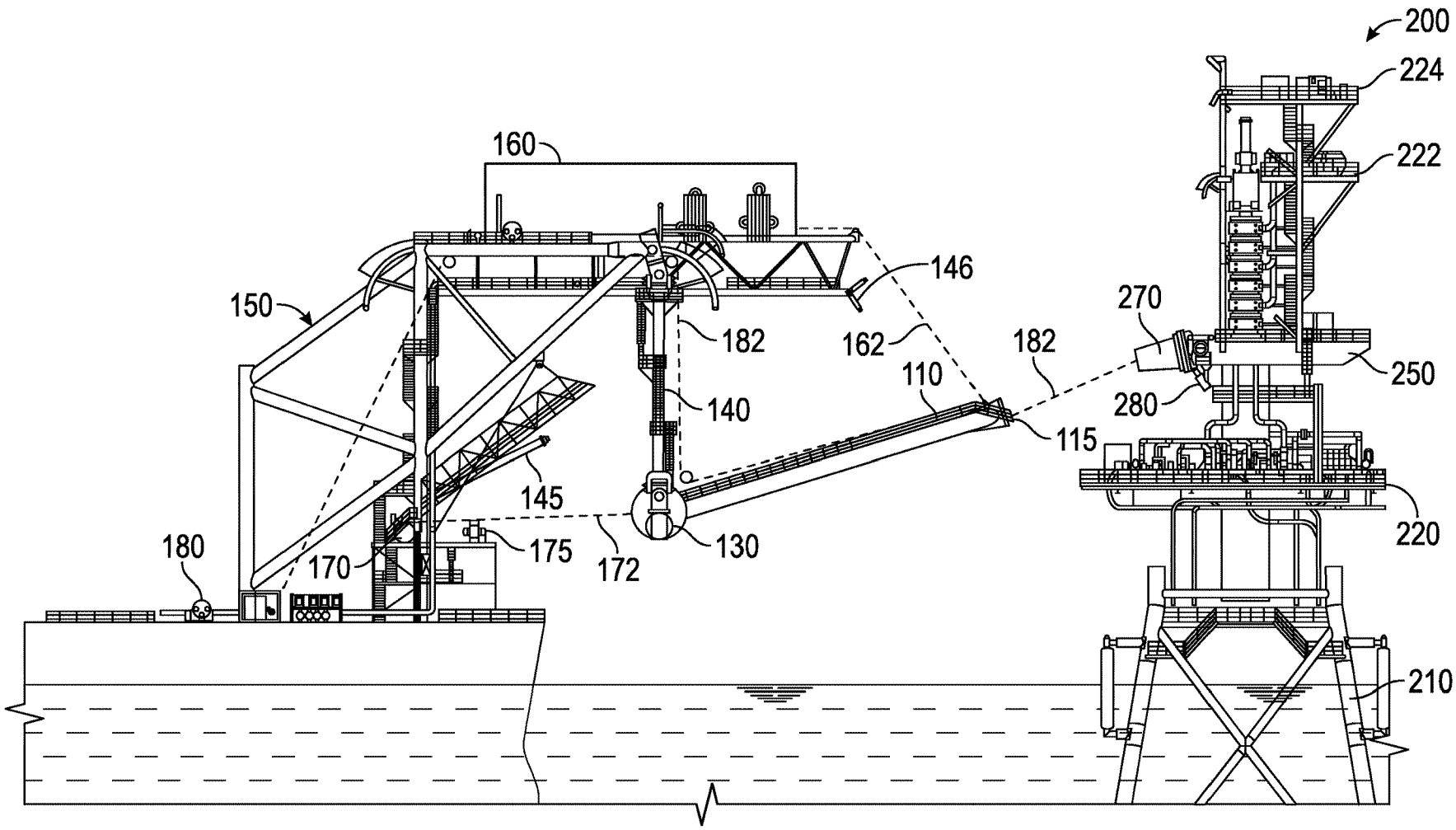
FIG. 4 depicts an illustrative schematic showing the pull-in line from the vessel connected to the tower prior to connection according to one or more embodiments provided herein.

The YMS 100 can further include a fourth winch system or pull-in winch system 180 for pulling the vessel 105 toward the tower structure 200, as depicted in FIG. 4, which depicts an illustrative schematic showing a pull-in line 182 from the pull-in winch system 180 through the yoke 110 to the tower structure 200. The pull-in winch system 180 and the pull-in line 182 can provide guidance for the structural connection of the yoke 110 to the tower structure 200. The pull-in line 182 can be any rope, cable, wire or the like, as well as any combinations of the same. Like the other winch systems 160, 170, 175, the pull-in winch system 180 can be or can include a dedicated hydraulic power unit and any combination of one or more winches, controls, compensating cylinders, sheaves, accumulators and/or oil coolers to provide rapid and reliable response times.

Figure 5:
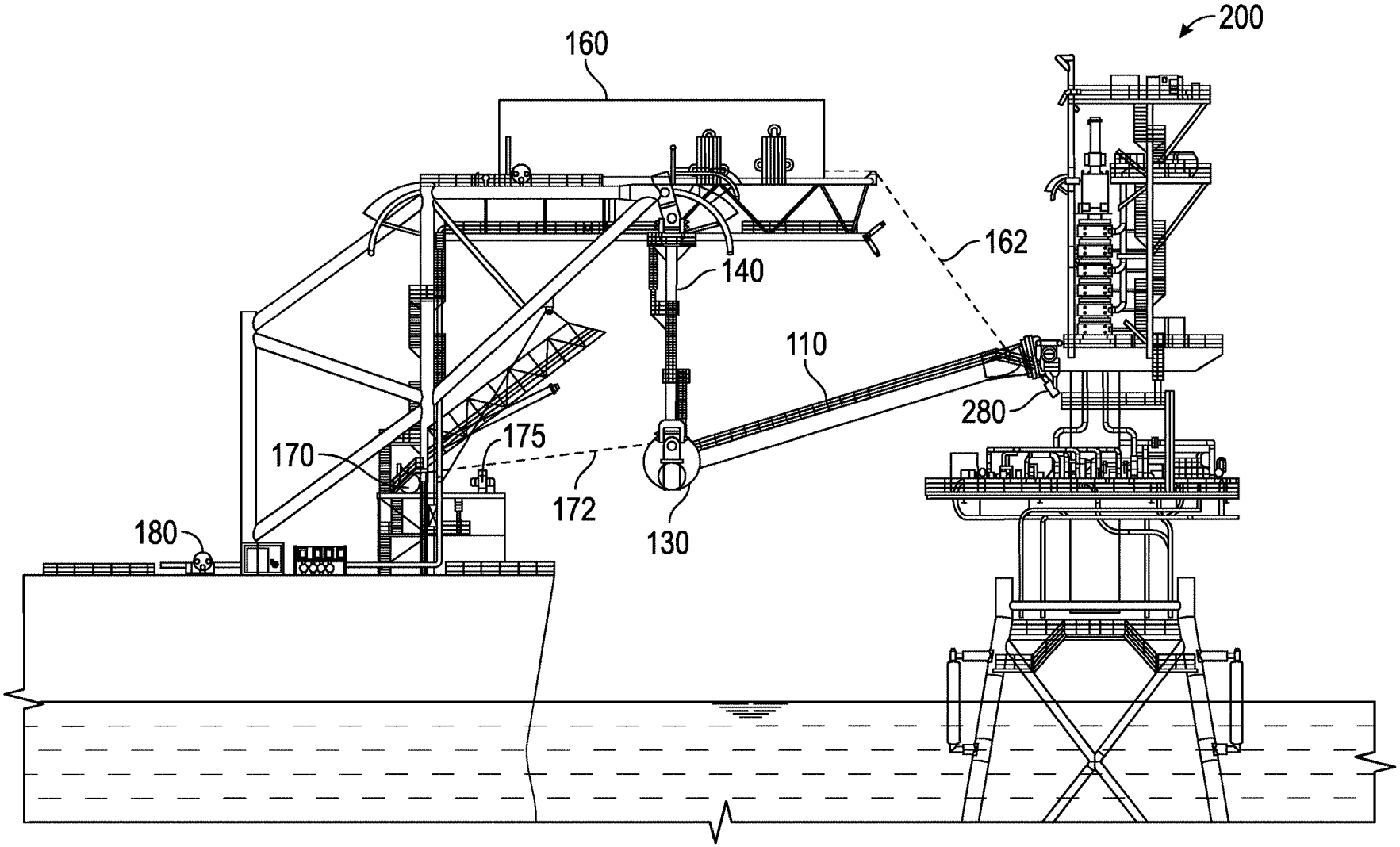
FIG. 5 depicts an illustrative schematic depicting the yoke connected to the tower according to one or more embodiments provided herein.
Figure 6:
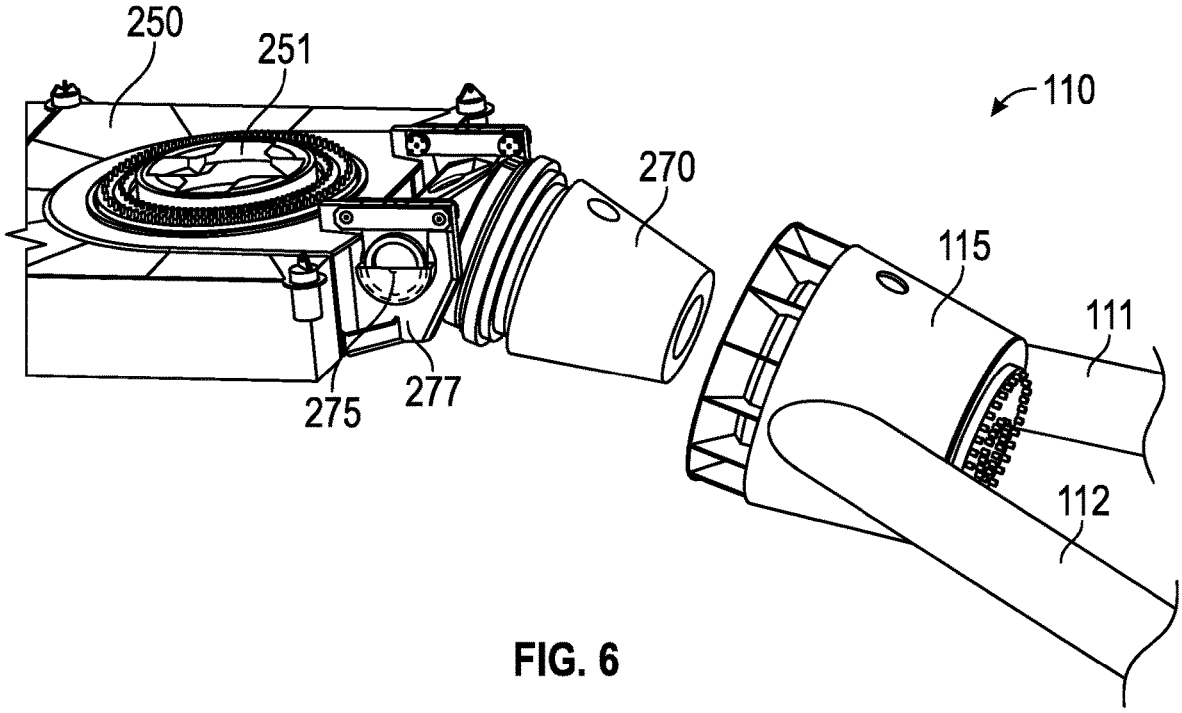
FIG. 6 depicts an enlarged perspective view of the yoke head on the vessel and the yoke head connector on the tower prior to connection, according to one or more embodiments provided herein.
Figure 7:
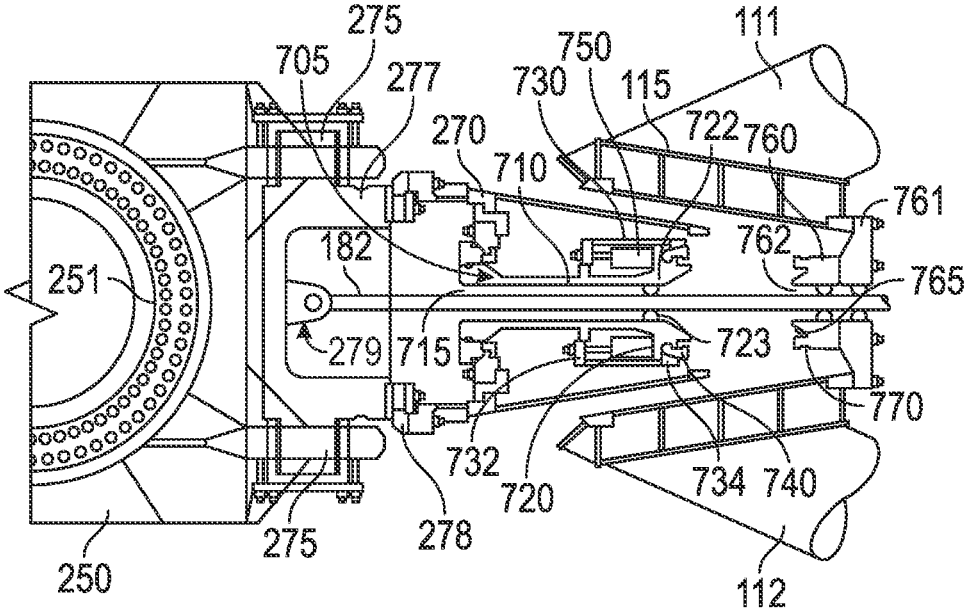
FIG. 7 depicts a partial cross section view of the yoke head on the vessel and the yoke head connector on the tower prior to connection, according to one or more embodiments provided herein.

FIG. 5 depicts an illustrative schematic depicting the yoke 110 connected to the tower structure 200. To facilitate this connection, the tower structure includes a yoke head connector or receptacle 270 located on the turntable 250 that receives the conical coupler or yoke head 115 located on or near the distal end of the yoke 110. The conical coupler or yoke head 115 can also be referred to as a tower connector. FIG. 6 depicts an enlarged perspective view of the yoke head 115 and the yoke head connector 270 and FIG. 7 depicts a partial cross section view of the yoke head 115 and the yoke head connector 270 prior to connection. The yoke head connector 270 can be arranged and designed to cooperate with the yoke head 115. Both the yoke head 115 and the yoke head connector 270 can have conical or frustoconical shaped surfaces: an inner surface of the yoke head 115 (female) and an outer surface of the yoke head connector 270 (male). These complementary surfaces provide a sliding surface to facilitate and guide the connection between the yoke head 115 and the yoke head connector 270.

Referring to FIGS. 6 and 7, the yoke head connector 270 can be mounted to the turntable 250 using one or more joints or connectors 275 that allow for pivotal movement relative to the turntable 250. In a preferred embodiment, the yoke head connector 270 is trunnion mounted to the turntable 250. The trunnion connector 275 can extend outwardly from a trunnion housing 277. One or more roll bearings 278 can be used to allow the yoke head connector 270 to rotate relative to the turntable 250. One or more cylinders 280 (FIG. 4), preferably a hydraulic cylinder, can be attached to the trunnion housing 277 and to the turntable 250. The cylinders 280 can be used to help move the yoke head connector 270 to facilitate the connection with the yoke head 115.

FIG. 7 depicts an enlarged schematic view of the working internals of the yoke head 115 and the yoke head connector 270. As depicted, a hydraulic connection assembly 705 can be mounted within the yoke head connector 270. The hydraulic connection assembly 705 can include a housing 710 having a bore 715 formed therethrough. The housing 710 can have an outwardly facing shoulder 720 and an extension or projection 722 formed thereon. One or more spaced apart fingers or collet segments 740 can be disposed about the housing 710 between the shoulder 720 and the projection 722. The outwardly facing shoulder 720 can be adjacent to and in contact with the fingers 740.

A movable sleeve 730 can be disposed about the housing 710. The movable sleeve 730 can have an inwardly directed flange 732 at one end and a band 734 at an opposite end. The band 734 can be adjacent to and configured to contact the one or more fingers 740. Linear movement of the sleeve 730 in a first direction (toward the vessel 105) allows the fingers 740 to rotate or pivot to a closed or locked position and linear movement of the sleeve 730 in an opposite, second direction (toward the tower 200) allows the fingers 740 to rotate or pivot about the outer surface of the housing 710 to an open or unlocked position.

One or more hydraulic cylinders or actuators 750 can used to move the sleeve 730 about the outer surface of the housing 710, allowing the fingers 740 to rotate or pivot open and close. The one or more actuators 750 can be positioned between and connected to the inwardly directed flange 732 of the movable sleeve 730 and the outwardly facing shoulder 720 of the stationary housing 710. The actuator(s) 750 can be hydraulic or pneumatic and are preferably hydraulic cylinders. When more than one actuator 750 are used, the actuators 750 are controlled by a singular control to provide simultaneous operation and movement of the sleeve 730. The actuators 750 can be actuated from the tower structure 200 by accumulators and telemetry-controlled valves. Accumulators and telemetry-controlled valves are well known to those skilled in the art.

Still referring to FIG. 7, the yoke head 115 can include a mating hub 760 for receiving and connecting to the hydraulic connection assembly 705 of the yoke head connector 270. An annular adapter or member 761 can be disposed on the yoke head 115 and can be used to mount the mating hub 760. The mating hub 760 also can be an annular member having a bore 762 formed therethrough. The mating hub 760 can include a recessed section or receptacle 765 that can be sized and shaped to receive the projection 722 on the assembly housing 710. The mating hub 760 can also include a notched or profiled outer surface 770. The profiled outer surface 770 can be configured to engage and hold a similarly contoured profile that can be disposed on the fingers 740 such that when the fingers 740 rotate or pivot to their locked or closed position, the shaped profiles located on the fingers 740 and the outer surface 770 of the mating hub 760 matingly engage one other, as depicted in FIG. 8.

Figure 8:
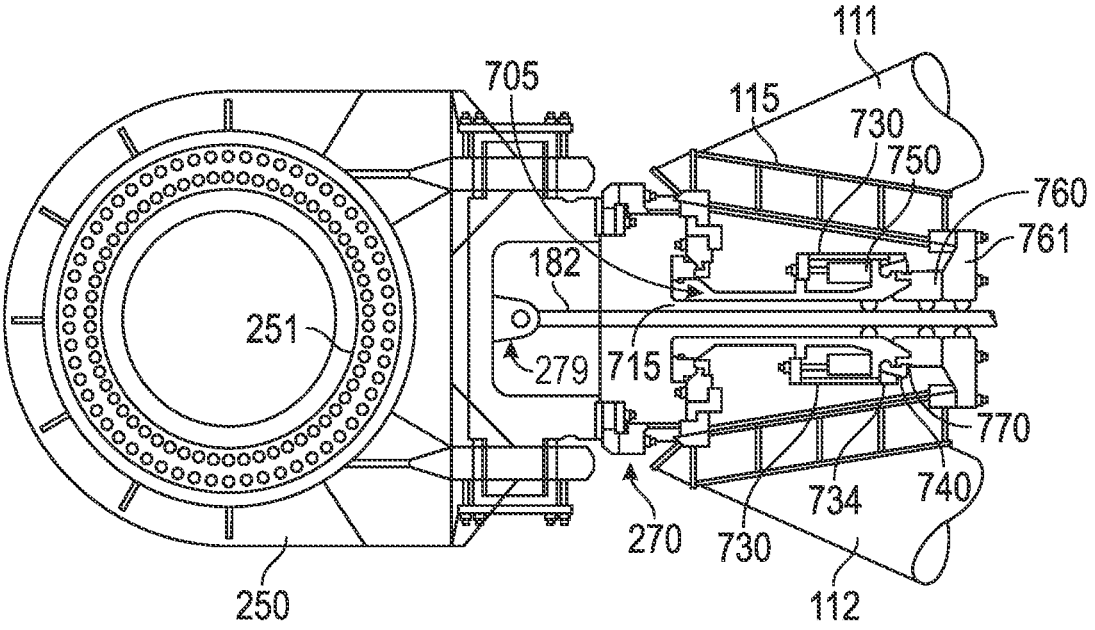
FIG. 8 depicts a partial cross section view of the yoke head connected to the yoke head connector, according to one or more embodiments provided herein.

FIG. 8 depicts a partial cross section view of the yoke head 115 connected to the yoke head connector 270. As depicted, the actuators 750 have moved the moveable sleeve 730 in the first direction toward the vessel 105, pushing the fingers 740 to rotate or pivot inwardly (toward the outer surface of the housing 710), such that the fingers 740 on the connector 270 engage the recessed profile 770 of the mating hub 760. In this closed position, the fingers 740 are generally parallel to the bore 715 of the housing 710 and overlap the profiled outer surface 770 on the mating hub 760, forming a lock and key engagement therebetween. Also in this closed position, the projection 722 on the housing 710 can be located within the receptacle 765 of the mating hub 760. As such, the yoke head connector 270 can be fully engaged with the yoke head 115 and the vessel 105 can be securely moored to the tower structure 200. While engaged, the yoke head 115 cannot move or rotate independent of the yoke head connector 270.

Figure 9:
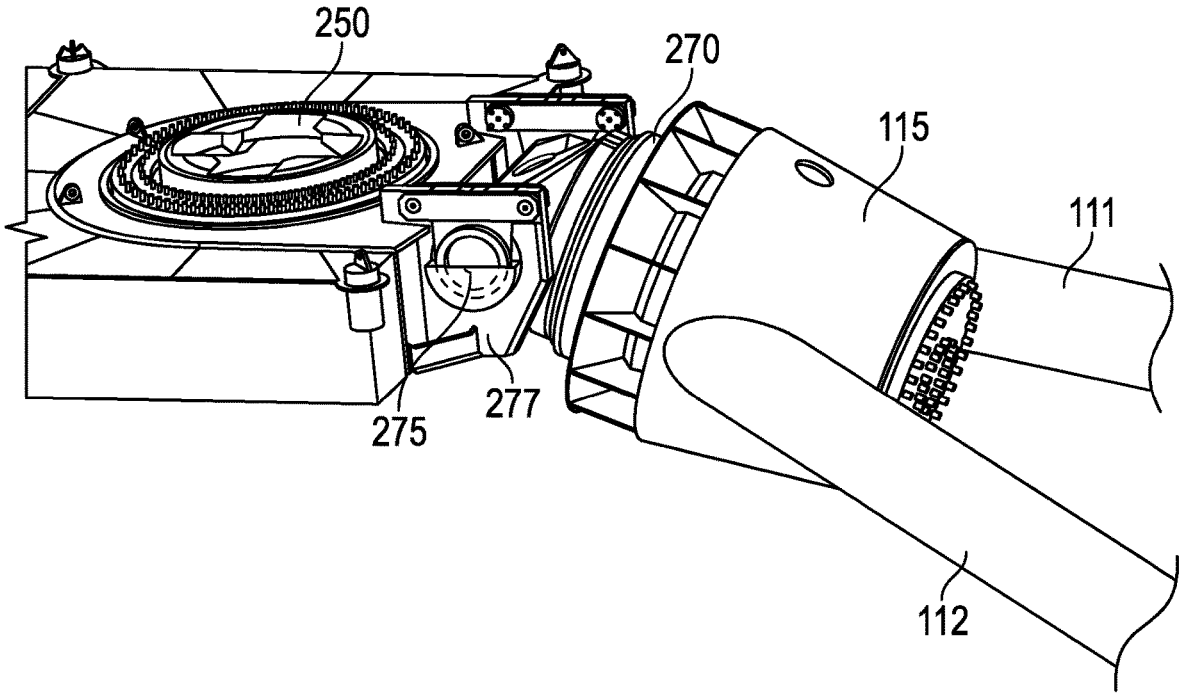
FIG. 9 depicts an enlarged perspective view of the yoke head connected to the yoke head connector, according to one or more embodiments provided herein.

FIG. 9 depicts an enlarged perspective view of the yoke head 115 connected to the yoke head connector 270 extending from the turntable 250. Although not shown, a secondary mechanical lock in line with the actuators 750 can be used to keep the connection without the need of hydraulic pressure. A suitable secondary mechanical lock can be an interference sleeve lock, such as for example, the Bear-Loc™ locking device, manufactured by Wellman Dynamics Machining and Assembly Inc. of York, Pa.

It should be readily appreciated by those skilled in the art that the hydraulic connection assembly 705 and the mating hub 760, as provided herein, permit a quick disconnect under load and can be performed at sea, under harsh conditions.

Referring again to FIG. 7, the rope or line 182 of the pull-in winch system 180 (shown best in FIG. 4) can be connected or otherwise attached to an eyelet 279 disposed on the trunnion housing 277 of the yoke head connector 270. This pull-in line 182 can thread through the bores 715 and 762 of the yoke head connector 270 and the yoke head 115, respectively, and serves as a guide for the yoke 110 and yoke head 115 during vessel 105 pull-in. Also shown in FIG. 7, one or more line guides 723 can be disposed within the bores 715, 762 to reduce chaffing or abrasion of the line 182.

Figure 10:
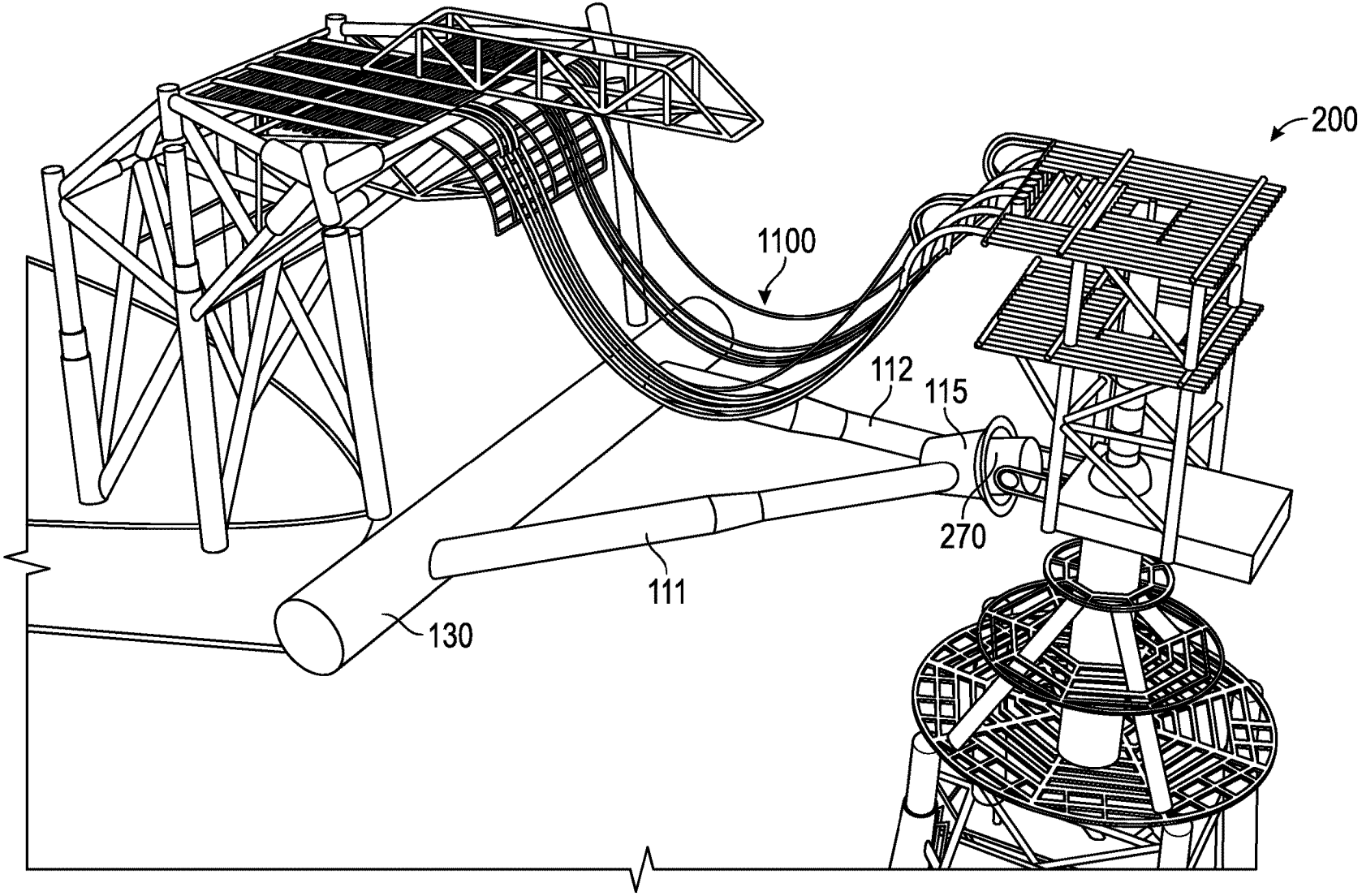
FIG. 10 depicts a schematic perspective view of the vessel moored to the tower with a fluid transfer system connected between the vessel and the tower, according to one or more embodiments provided herein.

FIG. 10 depicts a schematic perspective view of the vessel 105 moored to the tower structure 200 and a fluid transfer system connected therebetween, according to one or more embodiments provided herein. The fluid transfer system can include one or more flexible jumpers 1100 that can be any conduit for transferring oil, gas, water and utilities between the tower 200 and the vessel 105. The flexible jumpers 1100 can be U-shaped catenary to accommodate movement of the vessel 105 relative to the tower 200. During normal operations with the vessel 105 moored to the tower 200, one or more hoses, flow lines and cables 1100 provide fluid and/or electrical communications between the vessel 105 and the tower 200.

The connection or mooring sequence for connecting the vessel 105 to the tower structure 200 can be described in more detail referring to FIGS. 4 and 5. In operation, the yoke lift winch system 160 can be attached to the yoke 110 proximate the yoke head 115 and the vessel 105 can be moved closer to the tower structure 200 by its own propulsion, such as for example, using stern thrust supplied by the vessel's main propulsion system. The vessel 105 also can be moved closer or otherwise manipulated around the tower structure 200 using one or more external interventions, either exclusively or in combination with the vessel's main propulsion system, such as by one or more tugs, boats, ships or other vessel(s). By "close" it is meant less than 400 meters away, and such as about 200 to 350 meters or less than 60 meters away. As the vessel 105 nears the tower structure 200, the pull-in line 182 can be tossed onto the tower structure 200 where one end of the line 182 can be manually connected to the inside of the trunnion housing 277 within the yoke head connector 270. Another lead or line (not shown) can be used to pull the pull-in line 182 through the trunnion housing 277 to facilitate the connection of the pull-in line 182 within the yoke head connector 270.

The pull-in line 182 is run through the mating hub 760 of the yoke head 115 and connected to the pull-in winch 180. The pull-in line 182 can extend through the plurality of line guides 723 inside the connection assembly 705 and the mating hub 760, providing for initial guidance of the yoke head 115 as it approaches the yoke head connector 270 for connection. Additional guidance can be provided by the mating conical surfaces of the yoke head 115 and the yoke head connector 270. Once the pull-in line 182 is secured to the yoke head connector 270, the vessel's propulsion is reversed to ensure the vessel 105 does not collide with the tower 200. As the vessel 105 is propelled in reverse or otherwise away from the tower structure 200, the pull-in winch, working against the propulsion of the vessel 105, reels in the pull-in line 182, pulling the vessel 105 toward the yoke head connector 270 until the conical surface of the head 110 and the connector 270 substantially overlap. During this step, the cylinder 280 helps align and guide the yoke head connector 270, as the extension arms 140 and the yoke lift winch system 160 support and guide the yoke head 115. The yoke lift winch system 160 can be used to make small adjustments as the yoke head 115 approaches the yoke head connector 270. Once the conical surfaces of the yoke head 115 and the yoke head connector 270 are substantially engaged, the actuators 750 within the connection assembly 705 are actuated to move the sliding sleeve 730 and fingers 740 to mechanically connect the connection assembly 705 to the mating hub 760. A proximity switch can provide a signal when the yoke head 115 enters the yoke head connector 270. The signal can be sent to a solenoid actuated control valve to actuate the hydraulic connection assembly 705 inside the yoke head connector 270 and begin closing the fingers 740. The internal finger collet system provides a secure mechanical connection between the connection assembly 705 of the yoke head connector 270 and the mating hub 760 inside the yoke head 115. The vessel 105 is now connected to the tower structure 200 and successfully moored.

A proximity switch can provide indication that the fingers 740 are fully closed and locked. After the proximity switch sends a signal to the control and monitoring system, indicating that the yoke head connector 270 and yoke head 115 are locked, the trunnion cylinder 280 can be disengaged from the yoke head connector 270 and the yoke lift winch system 160 can be disengaged from the yoke 110. The line 182 of the pull-in winch system 180 may also be disconnected from the yoke head connector 270.

In the event the vessel 105 needs to disconnect from the tower structure 200, such as for example the completion or cessation of operations or excessive environmental conditions causing safety concerns, the vessel 105 can be easily and quickly disconnected from the tower structure 200. To disconnect the vessel 105 from the tower structure 200, the vessel's propulsion/engines are engaged, such as using the stern thrust, prior to the disconnection of the yoke 110. As mentioned above, the thrust can be supplied by the vessel's main propulsion system, or using one or more external interventions, either exclusively or in combination with the vessel's main propulsion system, such as by one or more tugs, boats, ships or other vessel(s). The thrust creates a constant tension away from the tower structure 200 and should be sufficient to overcome any current or wave forces acting on the vessel 105. The various hoses or flow lines and/or cables 1100 can be disconnected at the tower interface and retrieved to the vessel 105 and stored for transportation. Alternatively, the hoses, cables, and flow lines 1100 can be disconnected at the vessel 105 and stored on the hose deck 222 of the tower structure 200. The disconnection of these hydraulic lines can be done before or after the vessel thrust is applied.

Next, with the vessel's thrust applied away the tower structure 200, the yoke lift winch system 160 is actuated to pull taught the winch line 162 attached to the yoke head 115. The actuator(s) 750 of the connection assembly 705 inside the yoke head connector 270 is released or otherwise actuated to move the movable sleeve 730 in the second direction toward the tower structure 200, thereby releasing the fingers 740 from the mating hub 760 of the yoke head 115. Before or after releasing the fingers 740, the trunnion cylinder 280 can be actuated to orient the yoke head connector 270 horizontally, substantially horizontal or at any other suitable angle to allow the yoke head 115 to withdraw from the yoke head connector 270. Once the yoke head 115 is disconnected from the yoke head connector 270, the ballast tank 130 and the yoke head 115 can be controllably lifted or lowered relative to the support structure 150 using the rapid response capabilities of the yoke lift winch system 160. At the same time, the back and forth movement (or horizontal movement) of the ballast tank 130 and hence the yoke head 115 can be controlled using the rapid response capabilities of the pull-back winch system 170. The side to side movement of the ballast tank 130 can be further controlled using the rapid response capabilities of the spring line winch system 175. Working in combination with the yoke lift winch system 160 located above the yoke 110, the yoke pull-back winch system 170 located laterally or near lateral to the ballast tank 130, and optionally in combination with the spring line winch system 175, can effectively and reliably control the yoke 110, which significantly reduces the risk of banging or otherwise contacting the yoke 110 with the tower structure 200 or the vessel 105. This operation is particularly useful in relatively harsh conditions, which presents a real danger of collision between the vessel 105 and the tower 200, and/or the yoke 110 and the tower 200. Being able to apply the stern thrust prior to disconnection is a significant advantage for avoiding collision. The yoke pull-back winch system 170 can significantly control the release of the potential energy in the yoke mooring system caused by the stern thrust prior to disconnection, thereby allowing better control of the vessel 105 and the moveable yoke 110 once it has been disconnected from the tower 200.

Once disconnected, the vessel 105 can be prepared for deployment. To prepare for deployment, an upper portion or end of the yoke 110 can be secured to the support structure 150 using the upper transit arms 146 and the ballast tank 130 can be secured using the lower connection arms 145, as depicted in FIG. 2. Once secured, the winch lines 162, 172 can be released and the vessel 105 is ready to sail away.

Figure 11:
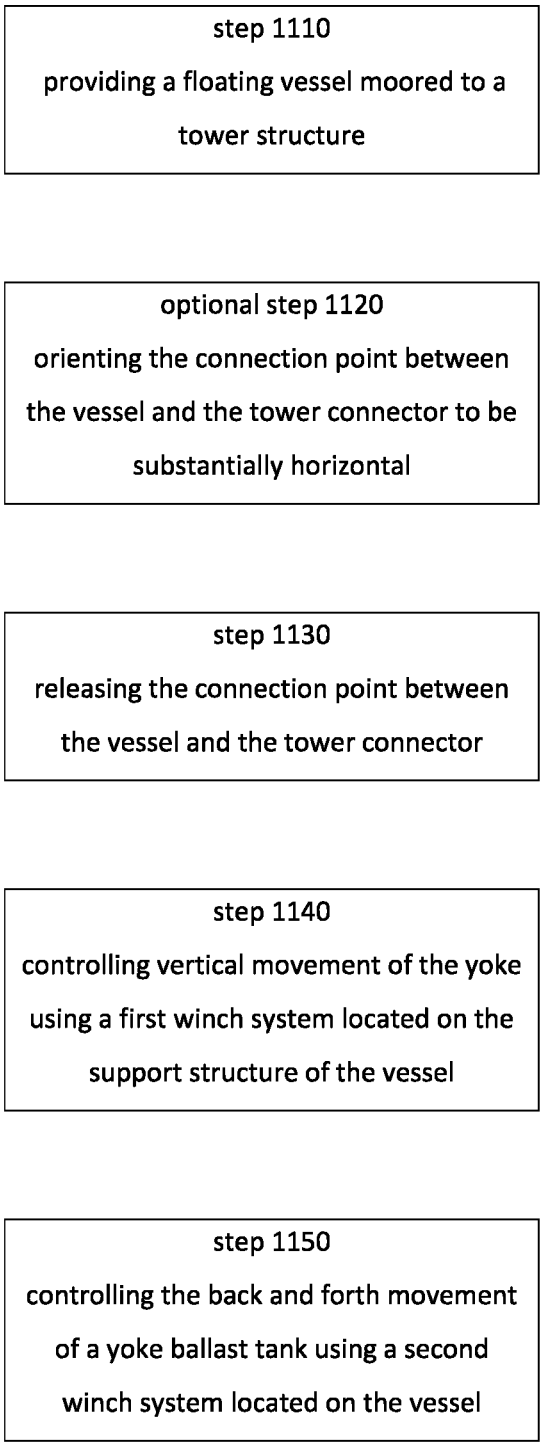
FIG. 11 is an illustrative flow process representing a method for disconnecting a moored vessel from a tower structure at sea, according to one or more embodiments provided herein.

FIG. 11 is an illustrative flow process representing one method for disconnecting a moored vessel from a tower structure at sea, according to one or more embodiments provided herein. In reference to FIG. 11, one method for disconnecting a moored vessel from a tower structure at sea comprises: (step 1110) providing a floating vessel moored to a tower structure; (optionally step 1120) orienting the connection point between the vessel and the tower connector to be substantially horizontal; (step 1130) releasing the connection point between the vessel and the tower connector; (step 1140) controlling vertical movement of the yoke using a first winch system located on the support structure of the vessel; and (step 1150) controlling the back and forth movement (or horizontal movement) of a yoke ballast tank using a second winch system located on the vessel.

FIG. 12 is an illustrative flow process representing another method for disconnecting a moored vessel from a tower structure at sea, according to one or more other embodiments provided herein. In reference to FIG. 12, one method for disconnecting a moored vessel from a tower structure at sea comprises: (step 1210) providing a floating vessel moored to a tower structure, the floating vessel comprising: a support structure mounted on an upper deck thereof; one or more extension arms suspended from the support structure; a ballast tank connected to the one or more extension arms, the ballast tank configured to move back and forth underneath the support structure; a yoke extending from and connected to the ballast tank at a first end thereof, the yoke comprising a tower connector disposed on a second end thereof; a first winch system located on the support structure, the first winch system connected to the yoke proximate the second end of the yoke via a first line or cable; and a second winch system connected to the ballast tank via a second line or cable, wherein the tower connector is attached to a yoke head connector disposed on the tower structure; (optional step 1220) orienting the yoke head connector and the tower connector to be substantially horizontal; (step 1230) applying stern thrust to the vessel, away from the tower structure; (step 1240) releasing the tower connector from the yoke head connector; (step 1250) controlling vertical movement of the yoke using the first winch system located on the support structure; and (step 1260) controlling the back and forth (i.e. horizontal) movement of the ballast tank using the second winch system.

The present disclosure further relates to any one or more of the following numbered embodiments:

1. A method for disconnecting a floating vessel moored to a tower structure at sea, comprising: providing a floating vessel comprising: a support structure mounted on an upper deck thereof; one or more extension arms suspended from the support structure; a ballast tank connected to the one or more extension arms, the ballast tank configured to oscillate back and forth underneath the support structure; a yoke extending from and connected to the ballast tank at a first end thereof, the yoke comprising a tower connector disposed on a second end thereof; a first winch system located on the support structure, the first winch system connected to the yoke proximate the second end of the yoke via a first line or cable; and a second winch system connected to the ballast tank via a second line or cable, wherein the tower connector is attached to a yoke head connector disposed on the tower structure; releasing the tower connector from the yoke head connector; controlling vertical movement of the yoke using the first winch system located on the support structure; and controlling the back and forth movement of the ballast tank using the second winch system.

2. The method of embodiment 1, further comprising mechanically linking the ballast tank and the second end of the yoke to the support structure.

3. The method of embodiments 1 or 2, wherein the support structure comprises a generally vertical portion and a cantilevered generally horizontal portion.

4. The method according to any embodiment 1 to 3, wherein the first winch system is located on the cantilevered generally horizontal portion of the support structure.

5. The method according to any embodiment 1 to 4, wherein releasing the tower connector from the yoke head connector comprises releasing pressure in a hydraulic cylinder to disconnect a collet connection between the yoke head connector and the tower connector.

6. The method according to any embodiment 1 to 5, further comprising applying thrust to the vessel, prior to releasing the tower connector from the yoke head.

7. The method according to any embodiment 1 to 6, wherein the first winch system is located above the ballast tank.

8. The method according to any embodiment 1 to 7, wherein the tower connector comprises a mating hub having a recess and a notched profile disposed on an outer surface thereof, the hub being an annular member having a bore formed therethrough.

9. The method according to any embodiment 1 to 8, wherein each winch system is electric, pneumatic, hydraulic or a combination thereof.

10. The method according to any embodiment 1 to 9, wherein each winch system comprises both electric and hydraulic actuated components.

11. A method for disconnecting a floating vessel moored to a tower structure at sea, comprising: providing a floating vessel comprising: a support structure mounted on an upper deck thereof; one or more extension arms suspended from the support structure; a ballast tank connected to the one or more extension arms, the ballast tank configured to move back and forth underneath the support structure; a yoke extending from and connected to the ballast tank at a first end thereof, the yoke comprising a tower connector disposed on a second end thereof; a first winch system located on the support structure, the first winch system connected to the yoke proximate the second end of the yoke via a first line or cable; and a second winch system connected to the ballast tank via a second line or cable, wherein the tower connector is attached to a yoke head connector disposed on the tower structure; orienting the yoke head connector and the tower connector to be substantially horizontal; releasing the tower connector from the yoke head connector; controlling vertical movement of the yoke using the first winch system located on the support structure; and controlling the back and forth movement of the ballast tank using the second winch system.

12. The method of embodiment 11, further comprising applying thrust to the vessel, prior to releasing the tower connector from the yoke head connector.

13. The method of embodiments 11 or 12, further comprising mechanically linking the ballast tank and the second end of the yoke to the support structure 14. The method according to any embodiment 11 to 13, wherein the support structure comprises a generally vertical portion and a cantilevered generally horizontal portion and wherein the first winch system is located on the cantilevered generally horizontal portion of the support structure.

15. The method according to any embodiment 11 to 14, wherein releasing the tower connector from the yoke head connector comprises releasing pressure in a hydraulic cylinder to disconnect a collet connection between the yoke head connector and the tower connector.

16. The method according to any embodiment 11 to 15, wherein the first winch system is located above the ballast tank.

17. The method according to any embodiment 11 to 16, wherein the tower connector comprises a mating hub having a recess and a notched profile disposed on an outer surface thereof, the hub being an annular member having a bore formed therethrough.

18. The method according to any embodiment 11 to 17, wherein each winch system is electric, pneumatic, hydraulic or a combination thereof.

19. The method according to any embodiment 11 to 18, wherein each winch system comprises both electric and hydraulic actuated components.

20. The method according to any embodiment 1 to 19, wherein a third winch system is connected to the ballast tank via a third line or cable for controlling side to side movement of the ballast tank.

21. The method according to embodiment 20, wherein the third winch system comprises a spring line winch system.

22. A method for disconnecting a floating vessel moored to a tower structure at sea, comprising: providing a floating vessel comprising a support structure mounted on an upper deck thereof; one or more extension arms suspended from the support structure; a ballast tank connected to the one or more extension arms, the ballast tank configured to oscillate back and forth underneath the support structure; a yoke extending from and connected to the ballast tank at a first end thereof, the yoke comprising a tower connector disposed on a second end thereof; a first winch system located on the support structure, the first winch system connected to the yoke proximate the second end of the yoke via a first line or cable for controlling vertical movement of the yoke; a second winch system connected to the ballast tank via a second line or cable for controlling back and forth horizontal movement of the ballast tank; and a third winch system connected to the ballast tank via a third line or cable for controlling side to side movement of the ballast tank, wherein the tower connector is attached to a yoke head connector disposed on the tower structure, orienting the yoke head connector and the tower connector to be substantially horizontal; applying stern thrust to the vessel, away from the tower structure; releasing the tower connector from the yoke head connector; controlling vertical movement of the yoke using the first winch system located on the support structure; controlling the back and forth movement of the ballast tank using the second winch system; and controlling side to side movement of the ballast tank using the third winch system, wherein the tower connector is released from the yoke head connector after the stern thrust is applied to the vessel.

23. The method according to embodiment 22, wherein the third winch system comprises a spring line winch system.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should be, therefore, expressly understood that such modifications and adaptations may be devised without departing from the basic scope thereof, and the scope thereof can be determined by the claims that follow.

What is claimed is:

1. A method for disconnecting a floating vessel moored to a tower structure at sea, comprising:

providing a floating vessel comprising:

a support structure mounted on an upper deck thereof;

one or more extension arms suspended from the support structure;

a ballast tank connected to the one or more extension arms, the ballast tank configured to oscillate back and forth underneath the support structure;

a yoke extending from and connected to the ballast tank at a first end thereof, the yoke comprising a tower connector disposed on a second end thereof;

a first winch system located on the support structure, the first winch system connected to the yoke proximate the second end of the yoke via a first line or cable; and a second winch system connected to the ballast tank via a second line or cable, wherein the tower connector is attached to a yoke head connector disposed on the tower structure;

releasing the tower connector from the yoke head connector;

controlling vertical movement of the yoke using the first winch system located on the support structure; and controlling the back and forth movement of the ballast tank using the second winch system.

2. The method of claim 1, further comprising, upon releasing the tower connector from the yoke head connector, mechanically linking the ballast tank with a first transit arm to the support structure and mechanically linking the second end of the yoke with a second transit arm to the support structure, wherein the first and second transit arms prevent the ballast tank and the yoke, respectively, from moving independent of the vessel.

3. The method of claim 1, wherein the support structure comprises a generally vertical portion and a cantilevered generally horizontal portion, wherein the first winch system is located on the cantilevered generally horizontal portion of the support structure, and wherein the second winch system is located beneath the first winch system on the generally vertical portion of the support structure or on a deck of the floating vessel.

4. The method of claim 1, further comprising applying thrust to the vessel, prior to releasing the tower connector from the yoke head.

5. The method of claim 1, wherein the first winch system is located above the ballast tank.

6. The method of claim 1, wherein each winch system is electric, pneumatic, hydraulic or a combination thereof.

7. The method of claim 1, wherein each winch system comprises both electric and hydraulic actuated components.

8. The method of claim 1, wherein the floating vessel further comprises a third winch system connected to the ballast tank via a third line or cable for controlling side to side movement of the ballast tank, the method further comprising controlling side to side movement of the ballast tank using the third winch system.

9. The method of claim 1, wherein the ballast tank comprises a ballast medium disposed within an internal volume thereof such that the ballast tank provides a counterbalance or restoring force as the vessel moves at sea.

10. A method for disconnecting a floating vessel moored to a tower structure at sea, comprising:

providing a floating vessel comprising:

a support structure mounted on an upper deck thereof;

one or more extension arms suspended from the support structure;

a ballast tank connected to the one or more extension arms, the ballast tank configured to move back and forth underneath the support structure;

a yoke extending from and connected to the ballast tank at a first end thereof, the yoke comprising a tower connector disposed on a second end thereof;

a first winch system located on the support structure, the first winch system connected to the yoke proximate the second end of the yoke via a first line or cable; and a second winch system connected to the ballast tank via a second line or cable, wherein the tower connector is attached to a yoke head connector disposed on the tower structure;

orienting the yoke head connector and the tower connector to be substantially horizontal;

releasing the tower connector from the yoke head connector;

controlling vertical movement of the yoke using the first winch system located on the support structure; and controlling the back and forth movement of the ballast tank using the second winch system.

11. The method of claim 10, further comprising applying thrust to the vessel, prior to releasing the tower connector from the yoke head connector.

12. The method of claim 10, further comprising, upon releasing the tower connector from the yoke head connector, mechanically linking the ballast tank with a first transit arm to the support structure and mechanically linking the second end of the yoke with a second transit arm to the support structure, wherein the first and second transit arms prevent the ballast tank and the yoke, respectively, from moving independent of the vessel.

13. The method of claim 10, wherein the support structure comprises a generally vertical portion and a cantilevered generally horizontal portion wherein the first winch system is located on the cantilevered generally horizontal portion of the support structure, and wherein the second winch system is located beneath the first winch system on the generally vertical portion of the support structure or on a deck of the floating vessel.

14. The method of claim 10, wherein releasing the tower connector from the yoke head connector comprises releasing pressure in a hydraulic cylinder to disconnect a collet connection between the yoke head connector and the tower connector.

15. The method of claim 10, wherein the tower connector comprises a mating hub having a recess and a notched profile disposed on an outer surface thereof, the hub being an annular member having a bore formed therethrough.

16. The method of claim 10, wherein each winch system is electric, pneumatic, hydraulic or a combination thereof.

17. The method of claim 10, wherein each winch system comprises both electric and hydraulic actuated components.

18. The method of claim 10, wherein the floating vessel further comprises a third winch system connected to the ballast tank via a third line or cable for controlling side to side movement of the ballast tank, the method further comprising controlling side to side movement of the ballast tank using the third winch system.

19. The method of claim 10, wherein the ballast tank comprises a ballast medium disposed within an internal volume thereof such that the ballast tank provides a counterbalance or restoring force as the vessel moves at sea.

20. A method for disconnecting a floating vessel moored to a tower structure at sea, comprising:

providing a floating vessel comprising:

a support structure mounted on an upper deck thereof;

one or more extension arms suspended from the support structure;

a ballast tank connected to the one or more extension arms, the ballast tank configured to oscillate back and forth underneath the support structure;

a yoke extending from and connected to the ballast tank at a first end thereof, the yoke comprising a tower connector disposed on a second end thereof;

a first winch system located on the support structure, the first winch system connected to the yoke proximate the second end of the yoke via a first line or cable for controlling vertical movement of the yoke;

a second winch system connected to the ballast tank via a second line or cable for controlling back and forth horizontal movement of the ballast tank; and a third winch system connected to the ballast tank via a third line or cable for controlling side to side movement of the ballast tank, wherein the tower connector is attached to a yoke head connector disposed on the tower structure, orienting the yoke head connector and the tower connector to be substantially horizontal;

applying thrust to the vessel, away from the tower structure;

releasing the tower connector from the yoke head connector;

controlling vertical movement of the yoke using the first winch system located on the support structure;

controlling the back and forth movement of the ballast tank using the second winch system; and controlling side to side movement of the ballast tank using the third winch system, wherein the tower connector is released from the yoke head connector after the stern thrust is applied to the vessel.

* * * * *